US008505642B2

(12) United States Patent
Cashion et al.

(10) Patent No.: US 8,505,642 B2
(45) Date of Patent: Aug. 13, 2013

(54) METHODS AND APPARATUS FOR DUAL STAGE HAZARD CONTROL SYSTEM

(75) Inventors: Brian J. Cashion, Gilbert, AZ (US); Dustin C. Moran, Glendale, AZ (US); Matthew Sampson, Phoenix, AZ (US); William A. Eckholm, Scottsdale, AZ (US)

(73) Assignee: Firetrace USA, LLC, Scottsdale, AZ (US)

( * ) Notice: Subject to any disclaimer, the term of this patent is extended or adjusted under 35 U.S.C. 154(b) by 934 days.

(21) Appl. No.: 12/612,797

(22) Filed: Nov. 5, 2009

(65) Prior Publication Data

US 2011/0100650 A1 May 5, 2011

(51) Int. Cl.

| | |
|---|---|
| ***A62C 2/00*** | (2006.01) |
| ***A62C 3/00*** | (2006.01) |
| ***A62C 35/02*** | (2006.01) |
| ***A62C 37/00*** | (2006.01) |
| ***A62C 31/22*** | (2006.01) |

(52) U.S. Cl.
USPC ..... 169/46; 169/26; 169/56; 169/57; 169/60; 169/70

(58) Field of Classification Search
USPC ..... 169/16, 20, 26, 29, 42, 46, 56, 57, 169/60, 70
See application file for complete search history.

(56) References Cited

U.S. PATENT DOCUMENTS

| | | | | |
|---|---|---|---|---|
| 2,911,049 | A | | 11/1959 | Lee et al. |
| 3,698,597 | A | | 10/1972 | Burke |
| 3,930,541 | A | | 1/1976 | Bowman et al. |
| 4,121,666 | A | | 10/1978 | Rozniecki |
| 4,132,271 | A | | 1/1979 | Mikaila |
| 4,194,979 | A | | 3/1980 | Gottschall |
| 4,215,752 | A | | 8/1980 | Waller |
| 4,251,579 | A | | 2/1981 | Lee et al. |
| 4,262,749 | A | | 4/1981 | Monte |
| 4,643,260 | A | * | 2/1987 | Miller ..... 169/46 |
| 4,652,383 | A | | 3/1987 | Tarpley, Jr. et al. |
| 4,893,680 | A | | 1/1990 | Wittbrodt et al. |
| 4,950,410 | A | | 8/1990 | Pennartz |
| 5,053,147 | A | | 10/1991 | Kaylor |
| 5,091,097 | A | | 2/1992 | Pennartz |
| 5,132,030 | A | | 7/1992 | Marx |
| 5,275,243 | A | | 1/1994 | Williams et al. |

(Continued)

FOREIGN PATENT DOCUMENTS

| | | | |
|---|---|---|---|
| FR | 635827 | A | 3/1928 |
| GB | 1380420 | A | 1/1975 |

(Continued)

*Primary Examiner* — Ryan Reis
(74) *Attorney, Agent, or Firm* — The Noblitt Group, PLLC

(57) ABSTRACT

Methods and apparatus for a dual stage hazard suppression system according to various aspects of the present invention include a housing containing a first hazard control material that is configured to be located close to a hazard source and a container containing a second hazard control material located at a distance from the hazard source. The housing may be configured to release the first hazard control material in response to a breach of the housing and/or the hazard source. The container may be configured for a timed release of the second hazard control material in response to the release of the first hazard control material. Alternatively, a sensor may be used to trigger the release of the second hazard control material in response to a triggering event separate from the initial breach of the housing and/or the hazard source.

19 Claims, 5 Drawing Sheets

(56) References Cited

U.S. PATENT DOCUMENTS

| | | | | |
|---|---|---|---|---|
| 5,304,313 | A | 4/1994 | Berger | |
| 5,388,339 | A | 2/1995 | Spector et al. | |
| 5,393,437 | A | 2/1995 | Bower | |
| 5,609,210 | A | 3/1997 | Galbraith et al. | |
| 5,762,145 | A | 6/1998 | Bennett | |
| 5,833,874 | A | 11/1998 | Stewart et al. | |
| 5,938,969 | A | 8/1999 | Morton | |
| 6,019,177 | A | 2/2000 | Olander | |
| 6,065,545 | A | 5/2000 | Williams | |
| 6,217,788 | B1 | 4/2001 | Wucherer et al. | |
| 6,676,081 | B2 | 1/2004 | Grabow et al. | |
| 6,708,771 | B2 * | 3/2004 | Reilly | 169/16 |
| 6,739,399 | B2 * | 5/2004 | Wagner et al. | 169/45 |
| 7,325,622 | B2 * | 2/2008 | Sjostrom | 169/73 |
| 7,434,628 | B2 * | 10/2008 | Scheidt | 169/7 |
| 2002/0020536 | A1 | 2/2002 | Bennett | |
| 2009/0178813 | A1 | 7/2009 | Eckholm et al. | |

FOREIGN PATENT DOCUMENTS

| | | | |
|---|---|---|---|
| GB | 1445832 | A | 8/1976 |
| GB | 1453836 | A | 10/1976 |
| GB | 1454492 | A | 11/1976 |
| GB | 1454493 | A | 11/1976 |
| GB | 1496852 | A | 12/1977 |
| GB | 1547568 | A | 6/1979 |

* cited by examiner

METHODS AND APPARATUS FOR DUAL STAGE HAZARD CONTROL SYSTEM

BACKGROUND OF INVENTION

Vehicles used in both ground and air operations may be subjected to multiple scenarios resulting in the outbreak of a fire on or in the vehicle. For example, a military aircraft operating in a congested urban environment may be subjected to multiple forms of attack such as small arms fire, anti-aircraft artillery, and surface-to-air projectiles. Each of these energetic ballistic threats may breach vehicle compartments such as a fuel tank causing a fire and/or an explosion.

Various methods and apparatus have been implemented to reduce the likelihood of fire or other hazardous event resulting from a breach of a containment system. For example, powder panels have been used as a non-electric passive system to protect against energetic ballistic threats. In one embodiment, these panels are designed to protect fuel tanks and their associated dry bays from ballistically induced fire by providing fire suppression capabilities at the point of ballistic impact. These systems are effective at preventing instantaneous fires from occurring but are much less effective against latent or slow growth fires which may also result from the initial ballistic breach.

SUMMARY OF THE INVENTION

Methods and apparatus for a dual stage hazard suppression system according to various aspects of the present invention include a housing containing a first hazard control material that is configured to be located close to a hazard source and a container containing a second hazard control material located at a distance from the hazard source. The housing may be configured to release the first hazard control material in response to a breach of the housing and/or the hazard source. The container may be configured for a timed release of the second hazard control material in response to the release of the first hazard control material. Alternatively, a sensor may be used to trigger the release of the second hazard control material in response to a triggering event separate from the initial breach of the housing and/or the hazard source.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described herein in terms of functional block components and various processing steps. Such functional blocks may be realized by any number of hardware components configured to perform the specified functions and achieve the various results. For example, the present invention may employ various housings, panels, connectors, sensors, and the like, which may carry out a variety of functions. In addition, the present invention may be practiced in conjunction with any number of hazardous containers or vehicles such as trucks, fixed wing aircraft, and rotorcraft, and the system described is merely one exemplary application for the invention. Further, the present invention may employ any number of conventional techniques for suppressing fires or other hazardous conditions, sensing environmental conditions, and the like.

Methods and apparatus for dual stage hazard suppression system according to various aspects of the present invention may operate in conjunction with any suitable mobile and/or stationary application. Various representative implementations of the present invention may be applied to any system for suppressing fires. Certain representative implementations may include, for example, an aircraft fuel tank a fuel line, or a storage tank.

Figure 1:
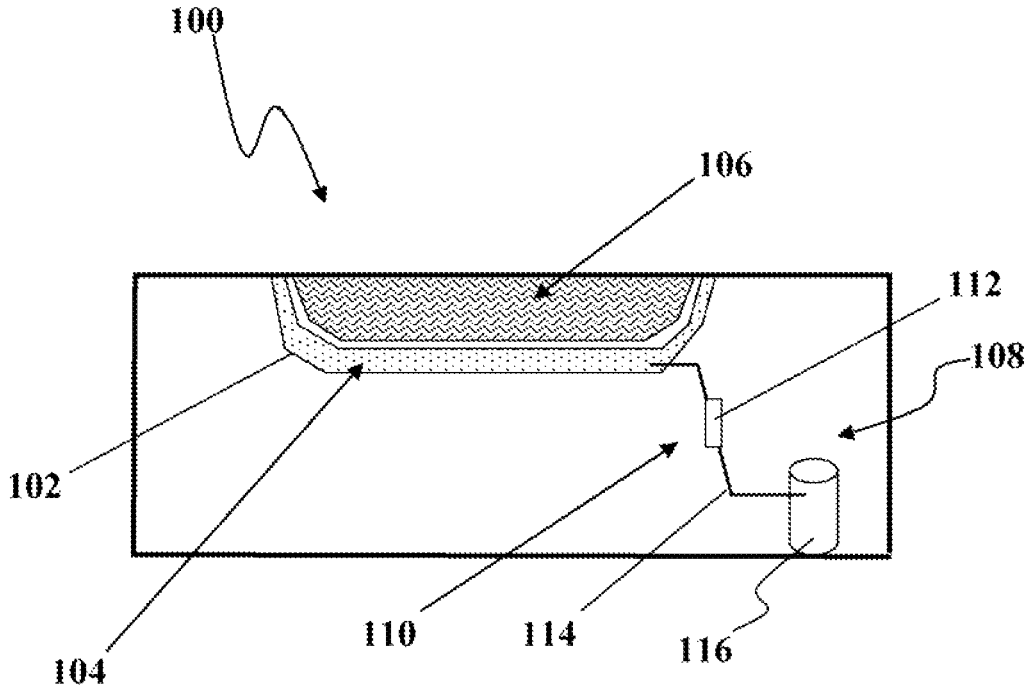
FIG. 1 representatively illustrates an exemplary embodiment of a passive fire suppression system.

Referring to FIG. 1, in one embodiment, methods and apparatus for a dual-stage hazard suppression system 100 may comprise a first hazard control system 102 configured to contain a first hazard control material 104. The first hazard control system 102 may at least partially cover, enclose, and/or be located immediately adjacent to a hazard source 106. The first hazard control system 102 may be linked to a second hazard control system 108 containing a second hazard control material through a distribution system 110.

The hazard source 106 contains a hazardous or potentially hazardous material such as fuel, chemicals, acids, and the like. The hazard source 106 may comprise any suitable device for containing the hazardous material such as a tank, a distribution line, a container, or a delivery system such as a pump. The hazard source 106 may also be disposed in any environment, location, or larger system and need not be a limited to a fixed position. For example, in one embodiment, the hazard source 106 comprises a fuel tank located in a moving vehicle such as a truck. In another embodiment, the hazard source 106 may comprise a fuel line disposed between the fuel tank of an aircraft and the aircraft engine.

The hazard source 106 may comprise any suitable material such as plastic, metal, elastomer, polymer, or suitable composite material, and may or may not be reinforced with additional materials such as armor plating. The hazard source 106 may also be configured in any suitable shape, size, or volume depending on a particular application. For example, the hazard source 106 may comprise a fuel line routed through and around various structures. In another embodiment, the hazard source 106 may comprise a fuel tank suitably configured to fit within a particular non-uniformly shaped volume. In yet another embodiment, the hazard source 106 may comprise a sealed volume of a larger structure such as a wet wing.

The first hazard control system 102 may be disposed adjacent to the hazard source 106 and be adapted to reduce the immediate dangers associated with release of the hazard material resulting from a transient event such as an energetic ballistic breach of a fuel tank. The first hazard control system 102 may comprise any suitable system for suppressing a hazardous event occurring substantially simultaneously with the release of a hazardous material such as a fire or explosion resulting from a high energy breach of a fuel tank. For example, referring to FIG. 2, in one embodiment, the first hazard control system 102 may comprise a substantially hollow multi-walled housing, such as a powder panel 202, suitably configured to cover at least a portion of a surface of the hazard source 106 and configured to contain a first fire suppressant 204. The powder panel 202 may be suitably adapted to release the first fire suppressant 204 in response to a breach of the hazard source 106 and the powder panel 202 by a projectile following a trajectory path 210.

Figure 2:
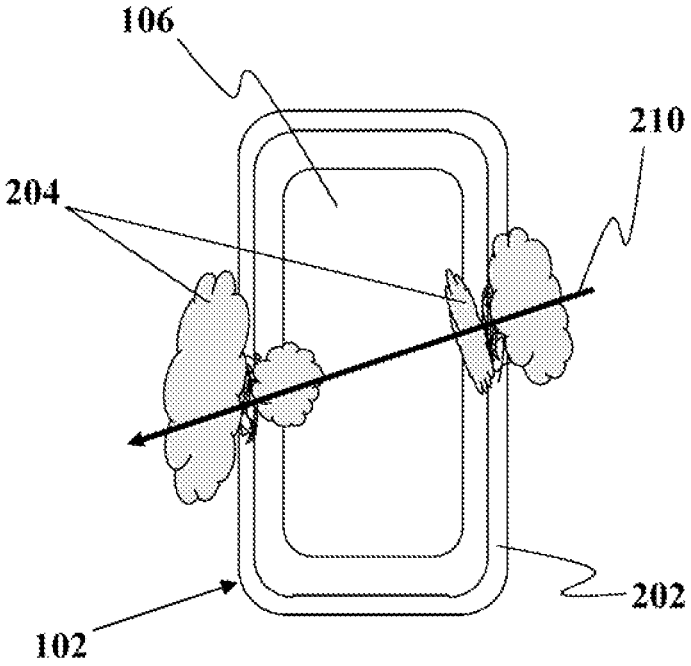
FIG. 2 representatively illustrates cross-sectional view of a breach of a hazard source and a hazard control system.
Figure 3:
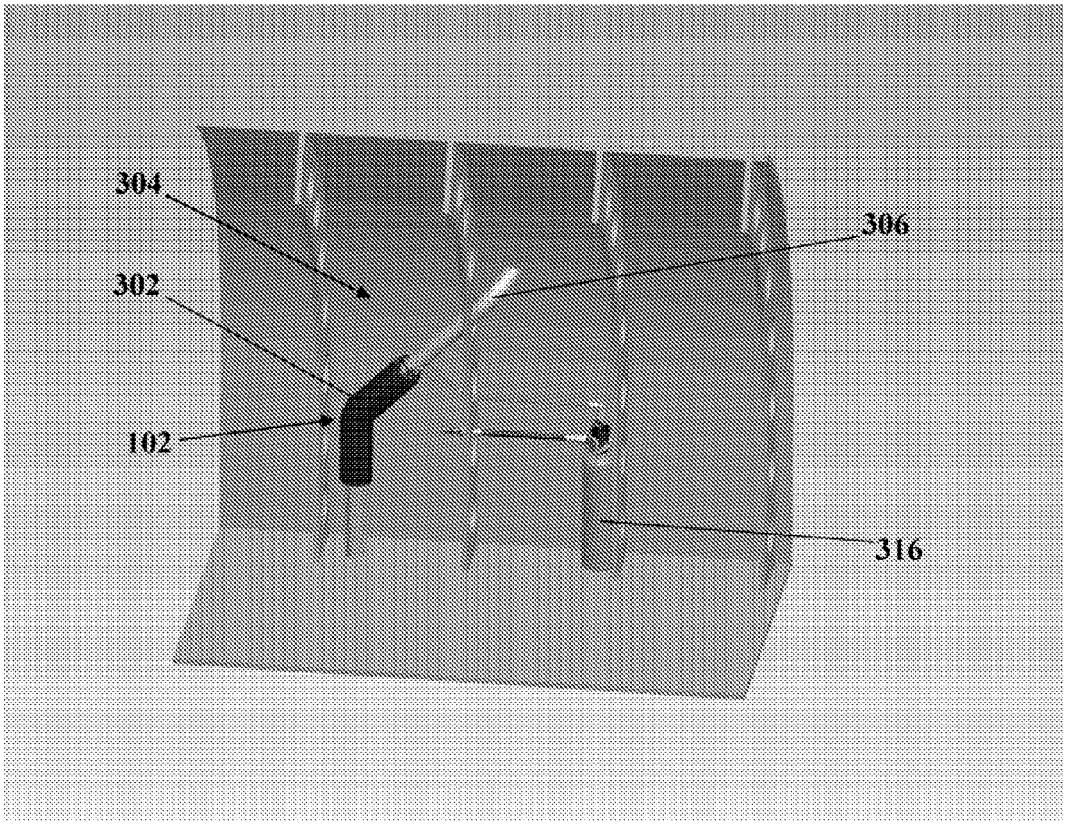
FIG. 3 representatively illustrates an exemplary embodiment of a dual stage system configured to release a second fire suppressant into an area surrounding a housing.
Figure 4:
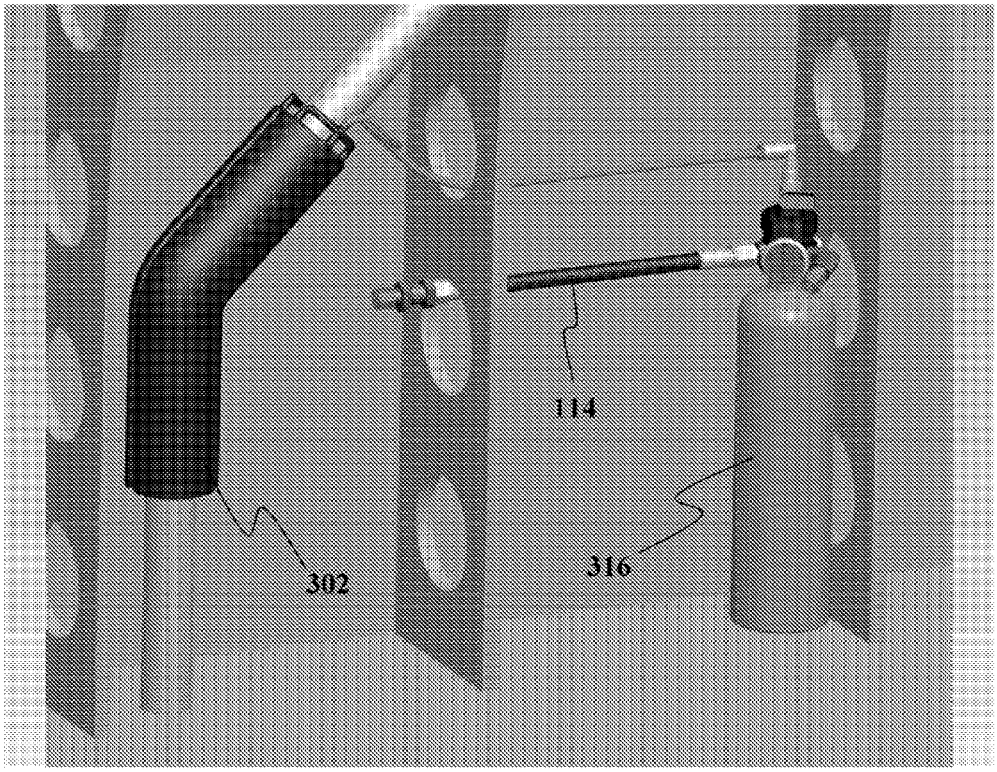
FIG. 4 representatively illustrates a close-up view of the dual stage system representatively illustrated in FIG. 3.
Figure 5:
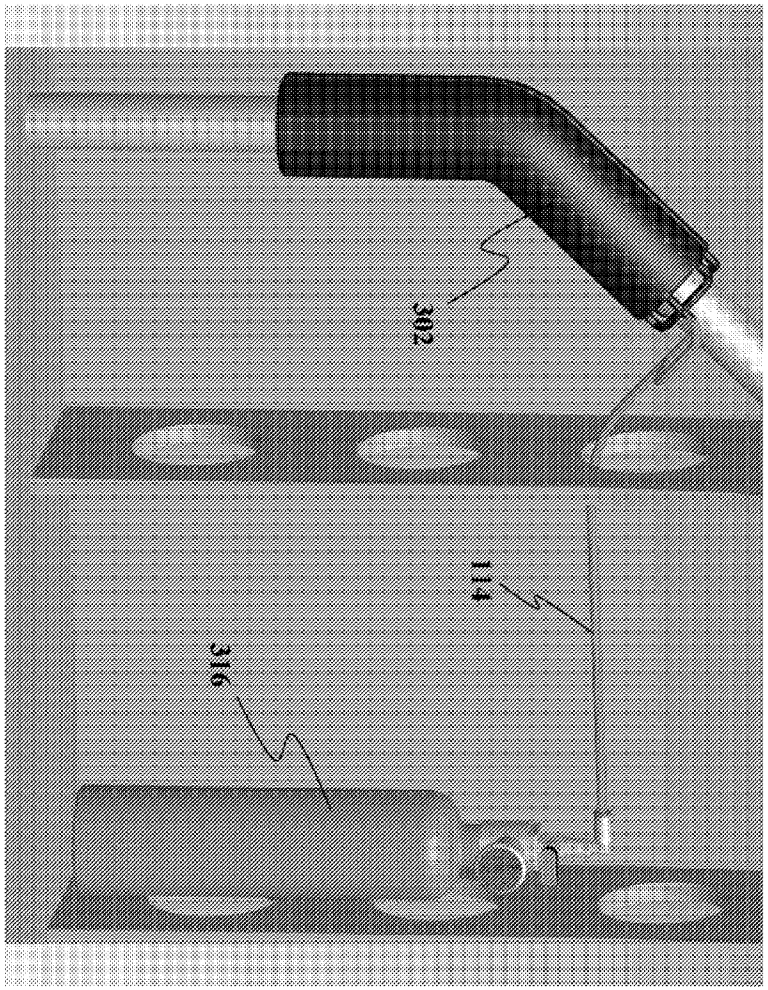
FIG. 5 representatively illustrates an exemplary embodiment of a dual stage system configured to release a second fire suppressant into a housing.

Referring now to FIGS. 3-5, in a second representative embodiment, the first hazard control system 102 may comprise a housing 302 configured to contain the first fire suppressant 204, as shown in FIG. 2, and be suitably configured to substantially conform to and wrap around a multi-dimensional surface such as a fuel line 306 or a fuel pump (not shown). The housing 302 may be further configured to release at least a portion of the first fire suppressant 204 in response to a breach of the housing 302 such as might occur from a bullet, shrapnel, or other projectile capable of breaching the fuel line 306 and causing a fire or explosion, in a similar fashion to that shown in FIG. 2. The housing 302 may be configured to release the first fire suppressant in such a manner as to fill an area or volume significantly larger the size of the breach, such as a fuel bay or other similar compartment 304. Alternatively, the housing 302 may be suitably configured to release first fire suppressant 204 into an area or volume substantially local to the location of the breach.

The first hazard control system 102 may also comprise any suitable material adapted to break, shatter, or otherwise compromise the structural integrity of the first hazard control system 102 either locally or as a whole in response to a breach. For example, in one embodiment the first hazard control system 102 material may comprise a rigid plastic suitably configured to rupture in an area surrounding the breach while leaving the rest of the first hazard control system 102 substantially intact. In a second embodiment, first hazard control system 102 may comprise a housing defining an inner volume, wherein the housing is comprised of multiple panels, each made of a different material and suitably adapted for a particular purpose such as more or less total breakage than the other panels. In a third embodiment, the first hazard control system 102 may comprise, in whole or in part, an acrylic material suitably configured to completely shatter in response to a transient event applied to any portion of the acrylic material.

The first hazard control system 102 may further be configured to contain the first hazard control material 104 under pressure relative to the surrounding environment and/or the hazard source 106. Alternatively, the first hazard control system 102 may be configured to withstand an increase in internal pressure of up to several hundred pounds per square inch (psi). For example, in one embodiment, the first hazard control system 102 may be configured to store the first hazard control material 104 above a pressure of about thirteen to seventeen psi but less than about 50 psi. In another embodiment, first hazard control system 102 may be suitably adapted to be sealed at a substantially ground level atmospheric pressure but used in a lower pressure environment such as an unpressurized compartment of an aircraft operating above an altitude of about 15,000 feet.

The second hazard control system 108 utilizes a second hazard control material to reduce the potential for a hazardous condition to develop after the first hazard control material 104 has been released. The second hazard control system 108 may comprise any suitable system for a controlled release hazard control agent. For example, the second hazard control system 108 may be responsive to a change in status of the first hazard control system 102 and be suitably adapted to release the second hazard control material over a period of time in response to the change in status. Alternatively, the second hazard control system 108 may be adapted to release the second hazard control material in response to a signal provided by a sensor.

Referring now to FIG. 1, in one embodiment, the second hazard control system 108 may comprise a container 116 containing the second hazard control material. The container 116 may be connectively linked to the first hazard control system 102 by a distribution system 110 comprising a tube 114 and/or a sensor 112.

The container 116 contains the second hazard control material and may comprise any suitable system for holding the second hazard control material such as a pressurized vessel, a bladder, a duct, and the like. The container 116 may be suitably configured to contain a mass or volume of any suitable hazard control material such as a liquid, gas, or solid material. The container 116 may also comprise any suitable material for a given application such as metal, plastic, or composite material. For example, referring to FIG. 3, the container 116 may comprise a pressurized pneumatic bottle 316.

The container 116 may be located near the first hazard control system 102 or positioned some distance away from the first hazard control system 102. For example, referring to FIG. 3, the pressurized pneumatic bottle 316 may be located in the same bay area of a structure but separated from the housing 302 by predetermined distance to reduce the likelihood of simultaneous damage to both the housing 302 and the pressurized pneumatic bottle 316. In another embodiment, the container 116 may be separated from the first hazard control system 102 by a bulkhead, be contained in a separate bay, or be positioned within a damage tolerant enclosure.

The container 116 may also be suitably configured to contain the second hazard control material under pressure. For example, in one embodiment, the container 116 may hold the second hazard control material at a pressure of up to about 360 pounds per square inch (psi). In a second embodiment, the container 116 may be configured to house the second hazard control material at a pressure of up to about 800-850 psi. In a third embodiment, the container 116 may be configured to hold the second hazard control material at a pressure substantially equal to the pressure of the first hazard control system 102.

The container 116 may also comprise a valve connecting the distribution system 110 to second hazard control material within the container 116. The valve may also control the release of', or rate of release of, the second hazard control material. The valve may comprise any suitable system for maintaining the pressurized volume of hazard control material and for releasing that volume upon demand. For example, the valve may comprise a seal between the second hazard control material and the tube 114 of the distribution system 110. The valve may be responsive to a signal from the sensor 112 and be suitably adapted to break, open, or otherwise remove the seal in response to a signal from the sensor 112. Once the seal has been broken the entire volume of the second hazard control material may be released to the distribution system 110.

In another embodiment, the valve may be suitably configured to control the rate of release of the second hazard control material. For example, the valve may comprise a selectively activated opening such as a ball or gate valve that is configured to release a predetermined mass flow rate of hazard control material. The rate of release may be dependent on a given application or location and may be related to the pressure within the container 116 relative to the ambient pressure in the first hazard control system or the surrounding environment.

The valve may also be configured to release the second hazard control material over a specific period of time. For example, the valve may be sized such that a total release of the second hazard control material occurs over a period of about sixty seconds. Alternatively, the valve may be suitably adapted to release the second hazard control material over a relatively short period of time such as 0.1 seconds. The valve may also be configured to sustain a constant level of the second hazard control in a given volume based on signals from the sensor 112.

The distribution system 110 delivers the second hazard control material after the second hazard control system 108 has been activated. The distribution system 110 may comprise any suitable system for delivering a hazard control material such as a pneumatic tube, a pipe, a duct, a perforated hose, or a sprayer. The distribution system 110 may also be configured to activate the second hazard control system 108 in response to a predetermined event such as a breach of the first hazard control system 102 or upon the sensing of a fire.

The distribution system 110 may comprise a sensor 112 adapted to detect a predetermined event and subsequently activate the second hazard control system 108 and/or provide an activation signal to the second hazard control system 108. The sensor 112 may comprise any suitable system for detection and signaling such as an infrared detector, a shock sensor, a thermocouple, a pressure gauge, or a temperature sensitive element.

The distribution system 110 may further be configured with a hazard control material delivery device such as a tube 114. The tube 114 may be configured to provide a conduit path for the second hazard control material from the second hazard control system 108 to the location where the second hazard control material is required. For example, referring to FIG. 5, in one embodiment, the tube 114 may provide a conduit path from the pressurized pneumatic bottle 316 to the inner volume of the housing 302 such that the second hazard control material is delivered at the location of the breached housing 302 over a sustained period of time following the initial release of the first hazard control material. Referring now to FIG. 4, in a second embodiment, the tube 114 may routed to an area surrounding the housing 302 such that the second hazard control material is delivered to the surrounding environment rather than solely to the location of the breached housing 302.

The tube 114 may comprise any suitable material such as metal, plastic, or polymer and may be suitably adapted to withstand elevated temperatures associated with fires or exposure to caustic chemicals. The tube 114 may also comprise a material that is specifically adapted to not withstand elevated temperatures. The tube 114 may also be pressurized or be configured to withstand pressures of up to 800 psi. For example, in one embodiment, the tube 114 may comprise a plastic pressurized tube, wherein the plastic is adapted to rupture or otherwise break in response to an applied heat load such as a fire.

The tube 114 may also be configured to act as the sensor 112. For example, in one embodiment, rupturing of the pressurized tube 114 may trigger the valve to release the second hazard control material. Alternatively, the tube 114 may be connected directly to the second hazard control material and held at a pressure equivalent to that of the second hazard control material in such a manner that a rupturing of the tube 114 causes the release of the second hazard control material.

The tube 114 may also be responsive to a loss in pressure to the first hazard control system 102. For example, referring again to FIG. 5, a pressurized tube 114 may be coupled to the inner volume of the housing 302 such that the pressure inside the tube 114 is equal to that of the inner volume of the housing 302. Therefore, if the housing 302 were breached resulting in a loss of pressure to the housing 302, the tube 114 would sense the loss of pressure and either trigger the valve or otherwise affect the release of the second hazard control material.

In yet another embodiment, a sealed and pressurized tube 114 could be routed over one or more surfaces of the first hazard control system 102 in such a manner as to cause the tube 114 to be breached substantially simultaneously with the first hazard control system 102. The breached tube 114 may then experience a loss in pressure causing an activation signal to the valve and/or second hazard control system 108.

The dual-stage hazard suppression system 100 may comprise one or more hazard control materials such as fire suppressants, neutralizing agents, or gasses. For example, one hazard control material may comprise a fire suppressant suitably adapted for transient events such as explosions or other rapid combustion and a second hazard control material may comprise a fire suppressant suitably adapted to suppress latent fires or other less rapidly developing fires. In one embodiment, the first hazard control material 104 may comprise a common dry chemical suppressant such as ABC, BC, or D dry powder extinguishants. In another embodiment, the first hazard control material 104 may comprise a suppressant material further comprising additional chemicals or compounds such as various forms or combinations of lithium, sodium, potassium, chloride, graphite, acetylene, oxides, and magnetite.

The hazard control material may also be adapted to have more than a single method of controlling the hazard. For example, the hazard control material may comprise multiple elements or compounds, wherein each compound has a different property such as being reactive or unreactive to heat, acting to deprive a fire of oxygen, absorbing heat from the fire, and/or transferring heat from the fire to another compound.

In another embodiment, the first and second hazard control materials may comprise the same materials, different materials, and/or differ in only respect to the concentration of each. The first and second hazard control materials may also be kept under pressure or dispersed within a given volume. For example, referring to FIG. 2, the first suppressant 204 may be substantially equally dispersed throughout the housing 202 while the second fire suppressant is maintained under pressure within the pneumatic bottle 316.

Referring now to FIG. 1, in operation, a first hazard control system 102 containing a first hazard control material 104 may be located adjacent to a hazard source 106. The first hazard control system 102 may be connectively linked to a second hazard control system 108 through a distribution system 110. The first hazard control system 102 may be suitably adapted to supply the first hazard control material 104 in response to a transient event such as a breach of the first hazard control system 102 and/or the hazard source 106.

For example, referring to FIG. 2, a powder panel 202 and the hazard source 106 may be breached by a high energy ballistic projectile moving along a trajectory 210. In response to the breach, the powder panel 202 releases a first fire suppressant 204 to suppress a fire or explosion that might result due to the release of a hazardous material from the hazard source 106. The powder panel 202 may be configured to cause all of the first fire suppressant to be released substantially simultaneously with the occurrence of the transient event. Referring again to FIG. 1, following the breach, the distribution system 110 may sense the release of the first hazard control material 104 and activate the second hazard control system 108.

A sensor 112 may be used to detect the breach, the release of the first hazard control material 104, and/or a later developing hazard condition such as a slow growth tire. For example, the sensor 112 may comprise a pressure sensitive element linked to an inner volume of the first hazard control system 102. The breach and/or subsequent release of the first hazard control material 104 may result in a loss of pressure to the inner volume. The sensor 112 may detect this change in pressure and trigger the second hazard control system 108 to release the second hazard control material through a tube 114.

Alternatively, the sensor 112 may comprise a sealed heat sensitive pressure tube 114 connected to a valve on the second hazard control system 108 that is adapted to rupture when subjected to a temperature above a specific level. For example, if the tube 114 was subjected to the heat associated with a fire, the tube 114 may rupture causing a loss in pressure to the valve thereby triggering the release of the second hazard control material.

Referring now to FIG. 3, the second hazard control system 108 may comprise a pressurized pneumatic bottle 316 that is suitably configured to hold the second hazard control material under pressure. For example, the second hazard control system 108 may comprise a low pressure delivery system configured to hold the second hazard control material at a pressure of less than about 360 psi. Alternatively, second hazard control system 108 may comprise a high pressure delivery system suitably configured to hold the second hazard control material at a pressure of up to about 850 psi.

When the second hazard control system 108 is activated the valve may control the rate of release of the second hazard control material. The distribution system may also control where the second hazard control material is delivered. For example, referring to FIG. 5, a loss in pressure of the housing 302 may trigger the valve of the low pressure delivery system to open and release the second hazard control material into the inner volume of the housing 302 over a period of about sixty seconds. Referring now to FIG. 4, in a high pressure delivery system, the valve may be configured to cause the release of the second hazard control material through the tube 114 over a period of less than one second such that an entire volume surrounding the housing 302 may be filled with the second hazard control material.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A dual-stage fire suppressant system for protecting against instantaneous and slow growth fires resulting from a breach of a potential fire source during a transient event, comprising:

a first fire suppressant system, comprising:
- a first fire suppressant; and
- a housing configured to at least partially enclose the potential fire source, comprising:
  - a first wall; and
  - a second wall connected to the first wall and defining an inner volume; and wherein the housing is configured to:
    - contain the first fire suppressant within the inner volume under a first pressure; and
    - release the first fire suppressant in response to the breach of the potential fire source and the housing during the transient event;

a second fire suppressant system responsively linked to the first fire suppressant system, comprising:
- a second fire suppressant; and
- a container positioned away from the housing and configured to contain the second fire suppressant under a second pressure; and a distribution system connected to the container, wherein the distribution system is adapted to:
- provide a signal to the second fire suppressant system in response to a predetermined event, wherein the signal causes the second fire suppressant system to release the second fire suppressant; and
- route the released second fire suppressant from the container to the housing.

2. A dual-stage fire suppressant system according to claim 1, wherein at least one of the first and second walls of the housing is configured to substantially conform to a surface of the potential fire source.

3. A fire suppressant system according to claim 1, wherein:

the predetermined event comprises a loss in pressure of the housing; and the distribution system further comprises a pressure sensor linked to the inner volume of the housing and configured to provide the signal in response to the loss in pressure of the housing.

4. A fire suppressant system according to claim 1, wherein the distribution system further comprises a heat sensitive element configured to:

rupture in response to an applied heat load occurring after the transient event to create the predetermined event; and provide the signal in response to a rupture of the heat sensitive element.

5. A fire suppressant system according to claim 4, wherein:

the heat sensitive element comprises a pressure tube; and the signal is generated in response to a loss in pressure of the pressure tube.

6. A fire suppressant system according to claim 1, wherein the distribution system further comprises a sensor disposed across a surface area of the housing and configured to provide the signal in response to the breach of the housing.

7. A fire suppressant system according to claim 1, wherein the container further comprises a valve adapted to control a rate of release of the second fire suppressant.

8. A fire suppressant system according to claim 1, wherein the second fire suppressant is released into the inner volume of the housing.

9. A fire suppressant system according to claim 1, wherein the second fire suppressant is released into an area proximate to the housing.

10. A dual-stage hazard control system for a hazard source which may be released during a transient event causing a breach in the hazard source, comprising:

a first hazard control agent;

a second hazard control agent;

a first hazard control system configured to at least partially enclose the potential fire source, wherein the first hazard control system:

is responsive to the transient event and configured to contain the first hazard control agent; and is configured to deliver the first hazard control agent to the hazard source substantially simultaneously with the occurrence of the transient event; and a second hazard control system linked to the first hazard control system, wherein the second hazard control system is configured to:

contain the second hazard control agent; and release the second hazard control agent over a predetermined period of time after the first hazard control agent has been delivered in response to an activation signal; and a sensor proximate to the first hazard control system, wherein the sensor is configured to generate the activation signal in response to a detected event following the transient event.

11. A dual-stage hazard control system according to claim 10, wherein the first hazard control system comprises a housing disposed adjacent to the hazard source, wherein:

the housing defines a volume to contain the first hazard control agent under a first pressure; and at least one surface of the housing is configured to rupture in response to the transient event and release the first hazard control agent at least proximate to the rupture location.

12. A dual-stage hazard control system according to claim 10, wherein the second hazard control system comprises container containing the second hazard control agent under a second pressure.

13. A dual-stage hazard control system according to claim 11, wherein the second hazard control system is configured to deliver the second hazard control agent to the inner volume of the housing.

14. A dual-stage hazard control system according to claim 11, wherein the second hazard control system is configured to deliver the second hazard control agent to an area proximate to the housing.

15. A method of controlling a fire resulting from a breach of a fire source, comprising:

at least partially enclosing the fire source with a sealed housing comprising an inner volume, wherein:

at least one wall of the housing substantially conforms to a surface of the fire source;

a first fire suppressant is contained within the inner volume of the housing under a first pressure; and the housing is configured to release the first fire suppressant in response to a breach of the housing;

positioning a sensor proximate to the housing, wherein the sensor is configured to generate a signal in response to a predetermined event;

linking a container to the sensor and the housing, wherein:

a second fire suppressant is maintained within the container under a second pressure;

the container is configured to release the second fire suppressant in response to the signal generated by the sensor.

16. A method of controlling a fire according to claim 15, wherein:

the predetermined event comprises a loss of pressure from the sealed housing; and generating the signal comprises sensing a loss of pressure from the inner volume of the housing.

17. A method of controlling a fire according to claim 15, wherein:

the predetermined event comprises sensing a fire with a heat sensitive element; and generating the signal comprises a change in the state of the heat sensitive element.

18. A. method of controlling a fire according to claim 17, wherein:

the heat sensitive element comprises a pressure tube linking the inner volume to the container; and the pressure tube is configured to rupture in response to an applied heat load.

19. A method of controlling a fire according to claim 15, wherein the container is further configured to release the second fire suppressant over a period of time.

* * * * *